US007004713B2

(12) United States Patent
Sweningson

(10) Patent No.: US 7,004,713 B2
(45) Date of Patent: Feb. 28, 2006

(54) BUCKET LOADER

(76) Inventor: Roger Sweningson, 34064 Highway 47 NW., Cambridge, MN (US) 55008

( * ) Notice: Subject to any disclaimer, the term of this patent is extended or adjusted under 35 U.S.C. 154(b) by 168 days.

(21) Appl. No.: 10/767,956

(22) Filed: Jan. 29, 2004

(65) Prior Publication Data

US 2004/0253088 A1 Dec. 16, 2004

Related U.S. Application Data

(60) Provisional application No. 60/443,514, filed on Jan. 29, 2003.

(51) Int. Cl.
*E02F 3/00* (2006.01)
*B66F 9/00* (2006.01)

(52) U.S. Cl. ..... 414/725; 414/722; 37/432

(58) Field of Classification Search ..... 414/722, 414/724, 725, 912; 141/35, 106, 108, 109, 141/114, 331, 344; 37/403, 411, 419, 427, 37/428, 429, 430, 432
See application file for complete search history.

(56) References Cited

U.S. PATENT DOCUMENTS 4,184,522 A * 1/1980 Waite ..... 141/231
5,004,022 A * 4/1991 Carlsson ..... 141/114
5,353,851 A 10/1994 Cline
5,437,318 A 8/1995 Kanzler et al.
5,564,886 A 10/1996 Emerson et al.
5,687,781 A 11/1997 Grizz
5,829,949 A 11/1998 Brown
5,873,396 A 2/1999 Biebrach et al.
5,885,053 A * 3/1999 Deye ..... 414/722
5,894,871 A 4/1999 Greer
5,947,347 A 9/1999 Cline, Sr.

* cited by examiner

*Primary Examiner*—Donald W. Underwood
(74) *Attorney, Agent, or Firm*—Patterson, Thuente, Skaar & Christensen, P.A.

(57) ABSTRACT

A bucket loader apparatus for scooping, filling, transporting and placing a plurality of bags used in constructing barriers. The bucket loader includes a universal mounting attachment for attachment to a loading vehicle whereby the loading vehicle manipulates the bucket loader between a range of dispositions. In a scooping disposition, the loading vehicle directs the bucket loader to scoop a flowable, granular material. In a loading disposition, the flowable granular material is directed through a plurality of integral funnels and into a plurality of bags, each funnel having a bag retained proximally to the funnel. After filling the bags, the bucket loader is transported to a point of use whereby the loading vehicle manipulates the loader bucket to an unloading disposition allowing placement of the filled bags. The bucket loader further includes a bag attachment assembly for selectively retaining empty bags and releasing filled bags.

16 Claims, 8 Drawing Sheets

BUCKET LOADER

PRIORITY CLAIM

The present invention claims priority to U.S. Provisional Application No. 60/443,514, entitled "BUCKET LOADER," filed Jan. 29, 2003, and hereby incorporated by reference in its entirety.

FIELD OF THE INVENTION

The subject of this invention is an apparatus for filling bags with pourable, granular material such as sand. In particular, this invention relates to a loader bucket that can be operably coupled to a host vehicle whereby the host vehicle can manipulate the loader bucket through a range of dispositions such that the loader buck can scoop a granular material, fill a plurality of bags with the granular material, transport the filled bags to a point of use and place the filled bags to form a barrier.

BACKGROUND OF THE INVENTION

In areas where flooding is a frequent occurrence, both temporary or permanent barriers such as levees created from bags filled with sand have been found to be effective in containing flood waters. Barriers created by using sandbags are also used in other situations such as environmental spills and drainage control. However, it is to be appreciated that in creating such a barrier, a large number of sandbags are typically needed in a short span of time.

Typically, sandbags are manually filled at the site by volunteers. This is a time consuming and backbreaking endeavor. When manually filling sandbags, each bag must be held open while sand is poured in by the shovelful. When filled, the sandbags are either hand carried to the barrier or are lifted into a transport mechanism such as a wheelbarrow or truck bed.

In an attempt to simplify this manual procedure, various sandbag filling devices have been proposed in the art. For example, U.S. Pat. Nos. 5,564,886; 5,829,949; 5,873,396; 5,894,871; 5,947,347 and 4,184,522 all disclose various attachments for filling one or more sandbags by way of an auger or gravity feed. However, these examples are expensive and inefficient solutions to the problem. Furthermore, they fail to address the issue of transporting and placing sandbags at the barrier.

There is a need then for a device that can fill multiple sandbags simultaneously and preferably place them in the desired location. The device should be able to perform equally well with wet or dry filler material. Furthermore, the device should be simple in design for greater reliability in that failure may result in unacceptable property damage. Therefore, there is a need for a reliable, efficient and low cost sandbag filling machine.

SUMMARY OF THE INVENTION

The present invention is a bucket loader, which addresses the needs outlined above. The invention relates to an apparatus capable of being mounted on a vehicle, such as a front-end loader, and used to scoop up and dispense granular, flowable material such as sand into a plurality of bags. The apparatus can then hold the bags while the loader is properly positioned for bag deployment at the barrier.

The apparatus comprises a bucket mounted on the arms of a front-end loader. The bucket includes a universal mounting plate for attachment to the loader. The bucket may be rotated as well as raised to a suitable height using the hydraulic arms of the loader. A portion of the bucket is shaped so that by suitably moving the loader and/or the arms of the loader, the bucket can be oriented to scoop and raise material into a cavity of the bucket. The bucket is further partitioned into a plurality of funnel shaped channels. One end of each funnel shaped channel communicates with the scooping cavity of the bucket while a dispensing end functions like a spout. The bucket contains a selectively rotatable bag attachment mechanism to retain a plurality of fillable bags, one bag for each of the funnel shaped channels, in an open position whereby each bag is proximally positioned to receive material from the dispensing end of the funnel shaped channels.

In operation, the cavity of the bucket is first loaded with sand in a manner set forth above, and then progressively tilted, using a hydraulic means on the loader, so as to cause the sand to flow toward the rear of the bucket and through the dispensing funnels into the bags thereby filling the bags with the sand. In one particular orientation of the bucket, the spouts of the channels are accessible for conveniently attaching the empty bags or unmounting the bags after they have been filled with sand. Once the bags have been filled, the bags maintain their relative position within the bucket while the loader is directed to a point of use. The bucket is then oriented such that the weight of the loaded bags causes a spring-loaded chute to open, thereby allowing the plurality of filled bags to slide down the chute to form the barrier.

One objective of the present invention is to provide a bucket attachment for loaders, which allows the user to load a quantity of flowable material into the bucket and dispense the flowable material simultaneously into a plurality of bags.

Another objective of the present invention is to provide a bucket attachment for loaders, which is substantially more reliable, less labor intensive and efficient than any flowable material dispenser of the prior art.

Another objective of the present invention is to provide a bucket attachment for loaders, which serves the dual function of simultaneously loading a plurality of bags and placing the loaded bags at a point of use to construct a barrier.

Yet another objective of the present invention is to provide a bucket attachment for loaders, which can be universally attached, detached and oriented with a variety of alternative loader configurations.

DETAILED DESCRIPTION OF THE PREFERRED EMBODIMENTS

Figure 1:
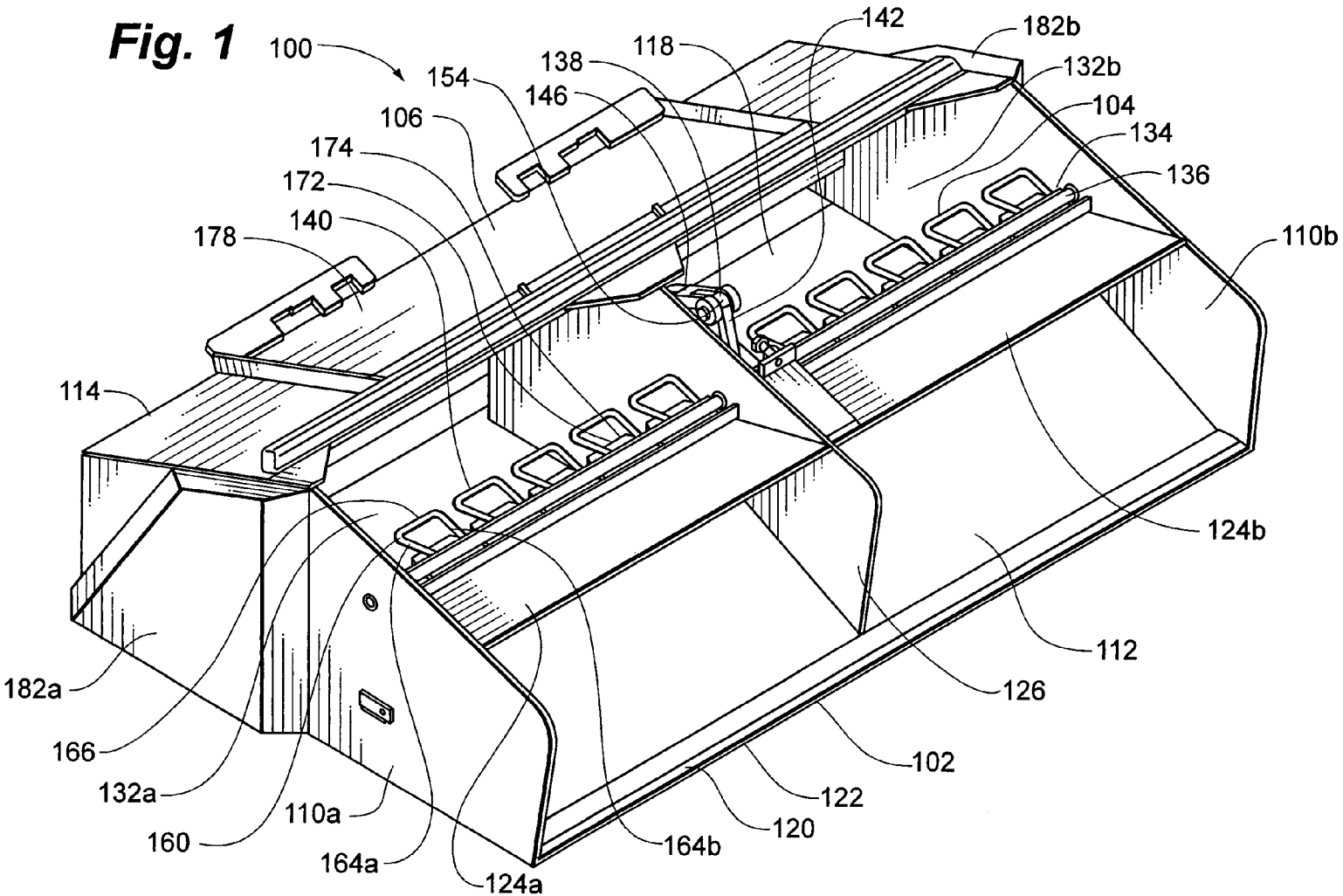
FIG. 1 is a front, perspective view of a bucket loader of the present invention.

A bag-filling bucket loader 100 of the present invention is depicted in FIGS. 1, 2, 3, 4, and 5. Bucket loader 100 has a generally box-like construction including a scoop portion 102, a bagging portion 104, a mounting portion 106 and an unloading portion 108. Generally, bucket loader 100 is a weldment assembly. Bucket loader 100 is preferably constructed of heavy-duty metal plate, for example, load bearing surfaces can comprise 5/16 inch metal plate while non-load bearing surfaces can comprise 3/16 inch metal plate to reduce the overall weight of bucket loader 100. Bucket loader 100 is defined by a pair of sidewalls 110*a*, 110*b*, a scoop floor 112, a mounting wall 114, a rear support wall 116 and chute wall 118.

Figure 2:
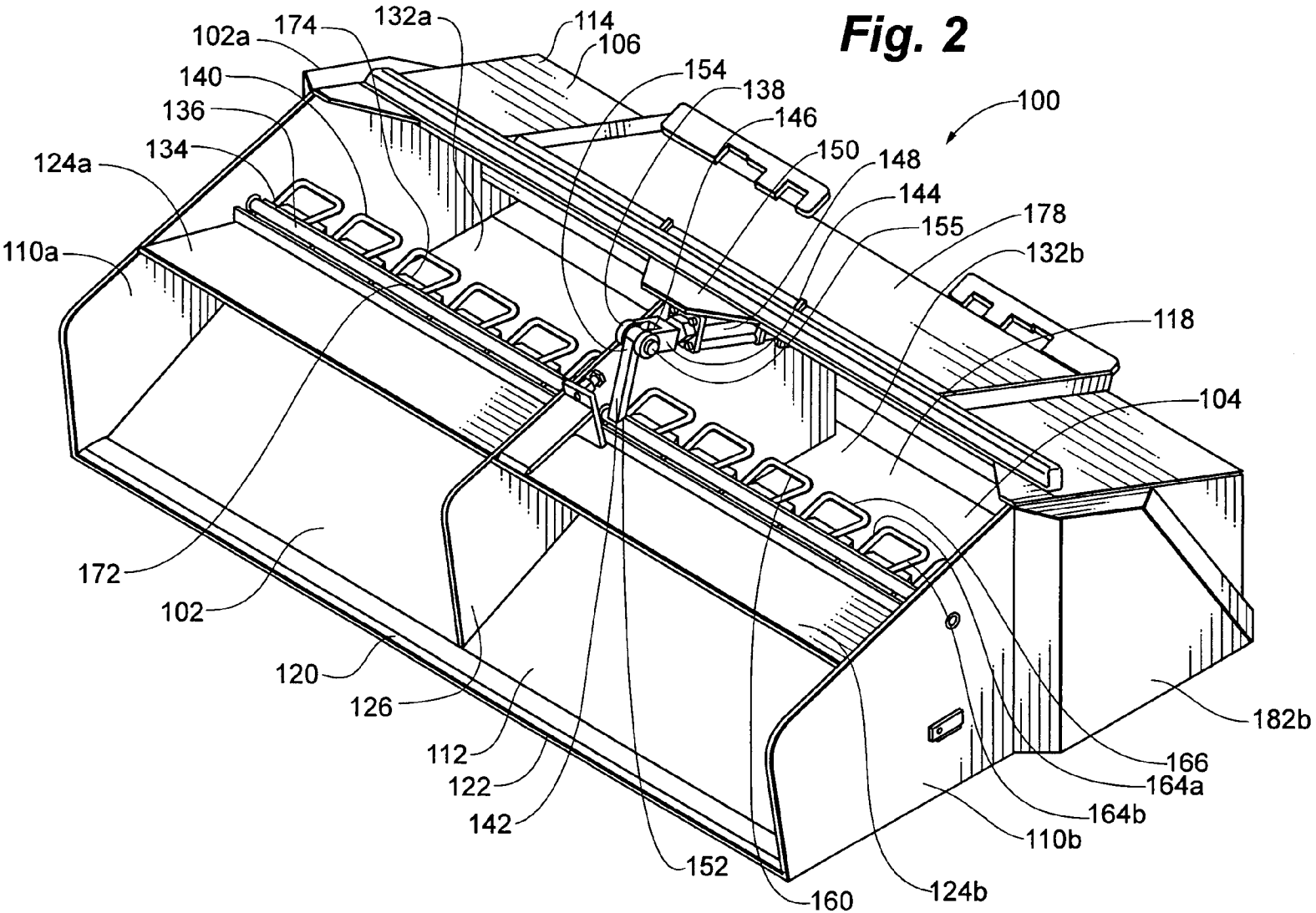
FIG. 2 is a front, perspective view of the bucket loader of FIG. 1.
Figure 3:
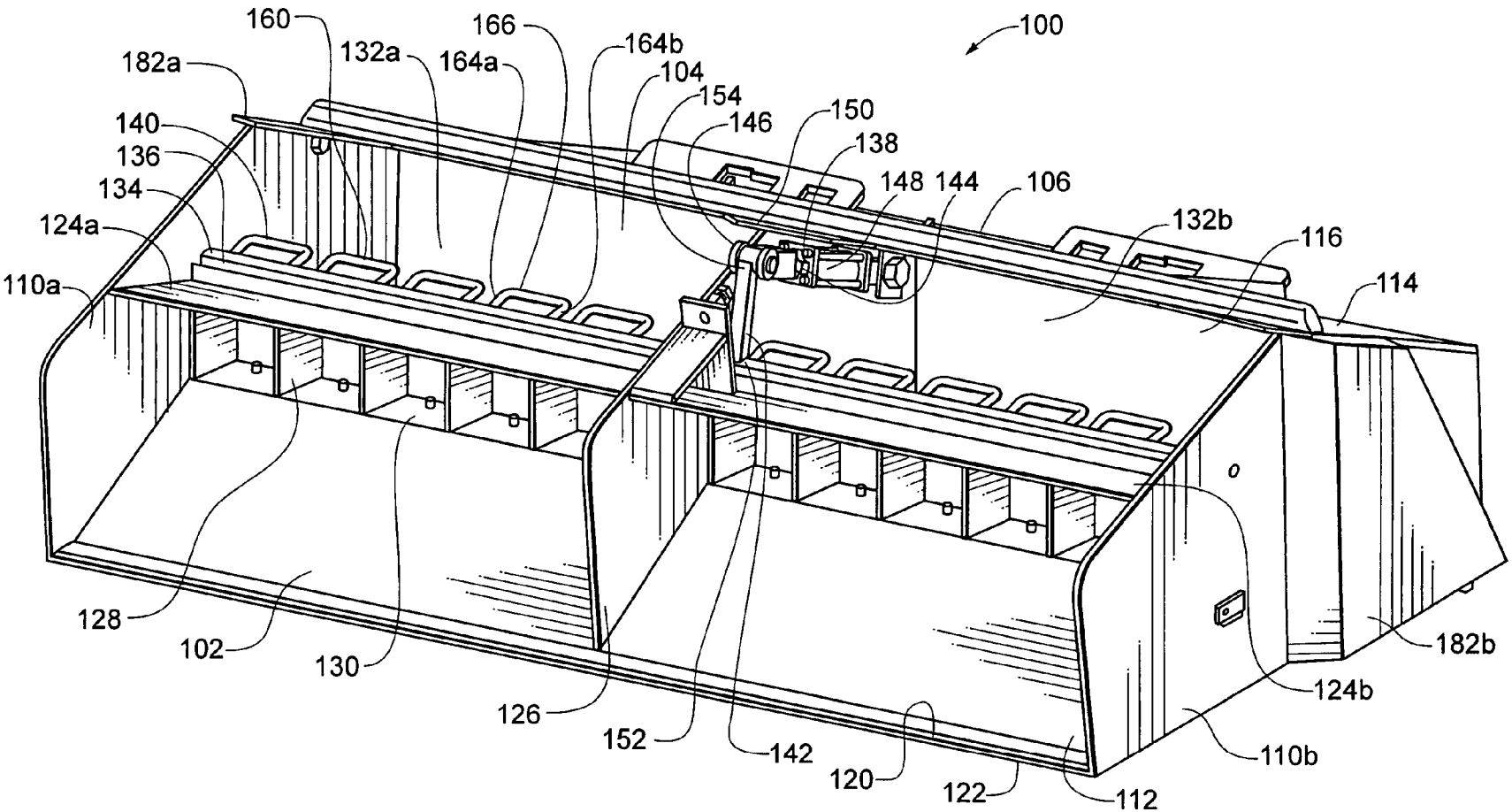
FIG. 3 is a front, perspective view of the bucket loader of FIG. 1.

At the front of scoop portion 102 as shown in FIGS. 1, 2 and 3, the scoop floor 112 includes a tapered or angled scoop surface 120 having a leading edge 122. Scoop portion 102 includes a pair of funnel walls 124*a*, 124*b* separated by a center support wall 126. Funnel walls 124*a*, 124*b* are angled with respect to the scoop floor 112 such that the spacing between funnel walls 124*a*, 124*b* and the scoop floor 112 is at a maximum toward leading edge 122. Mounted between funnel walls 124*a*, 124*b* and the scoop floor 112 is a plurality of funnel dividing walls 128. The combination of funnel walls 124*a*, 124*b*, scoop surface 120 and funnel dividing walls 128 define a plurality of individual funnels 130. As depicted, bucket loader 100 includes twelve funnels 130. In alternative configurations, bucket loader 100 can comprise varying numbers of funnels 130, most typically dependent on an overall lifting capacity of a loading vehicle.

As depicted in FIGS. 1, 2, and 3, bagging portion 104 defines a pair of bag retaining areas 132*a*, 132*b*. Mounted within bagging portion 104 is a retaining assembly 134. Retaining assembly 134 comprises a rotation rod 136, a mounting rod 137, a rotation assembly 138 and a plurality of flapper assemblies 140. Rotation rod 136 and mounting rod 137 can be constructed of suitable rod or pipe. Rotation rod 136 is rotatably mounted between the sidewalls 110*a*, 110*b* and through center support wall 126. Mounting rod 137 is attached, by welding or suitably fastening means, in position between the sidewalls 110*a*, 110*b* and through the center support wall 126 in parallel alignment with the rotation rod 136 but on an opposed side of the funnels 130. The rotation assembly 138 is operably mounted between the retaining rod 136 and the mounting wall 114.

The rotation assembly 138 shown in FIGS. 1, 2, 3 and 4 comprises a rotation arm 142, a mounting arm 144, a hinge bracket 146, a piston assembly 148 and a piston mounting bracket 150. The piston assembly 148 includes a connector for operably connecting the piston assembly 148 with a suitable, external drive source, for example a pneumatic, hydraulic, or electrical source. A first end 152 of the rotation arm 142 is welded to the retaining rod 136 while a second end 154 includes a throughbore for coupling the rotation arm 142 to the hinge bracket 144 with a hinge pin 155. The hinge bracket 144 can be integral with or welded to a movable piston of the piston assembly 148. The piston assembly 148 can be attached to the piston mounting bracket 150 by welding or with a suitable fastener. Piston mounting bracket 150 is preferably welded to the mounting wall 114.

Figure 6:
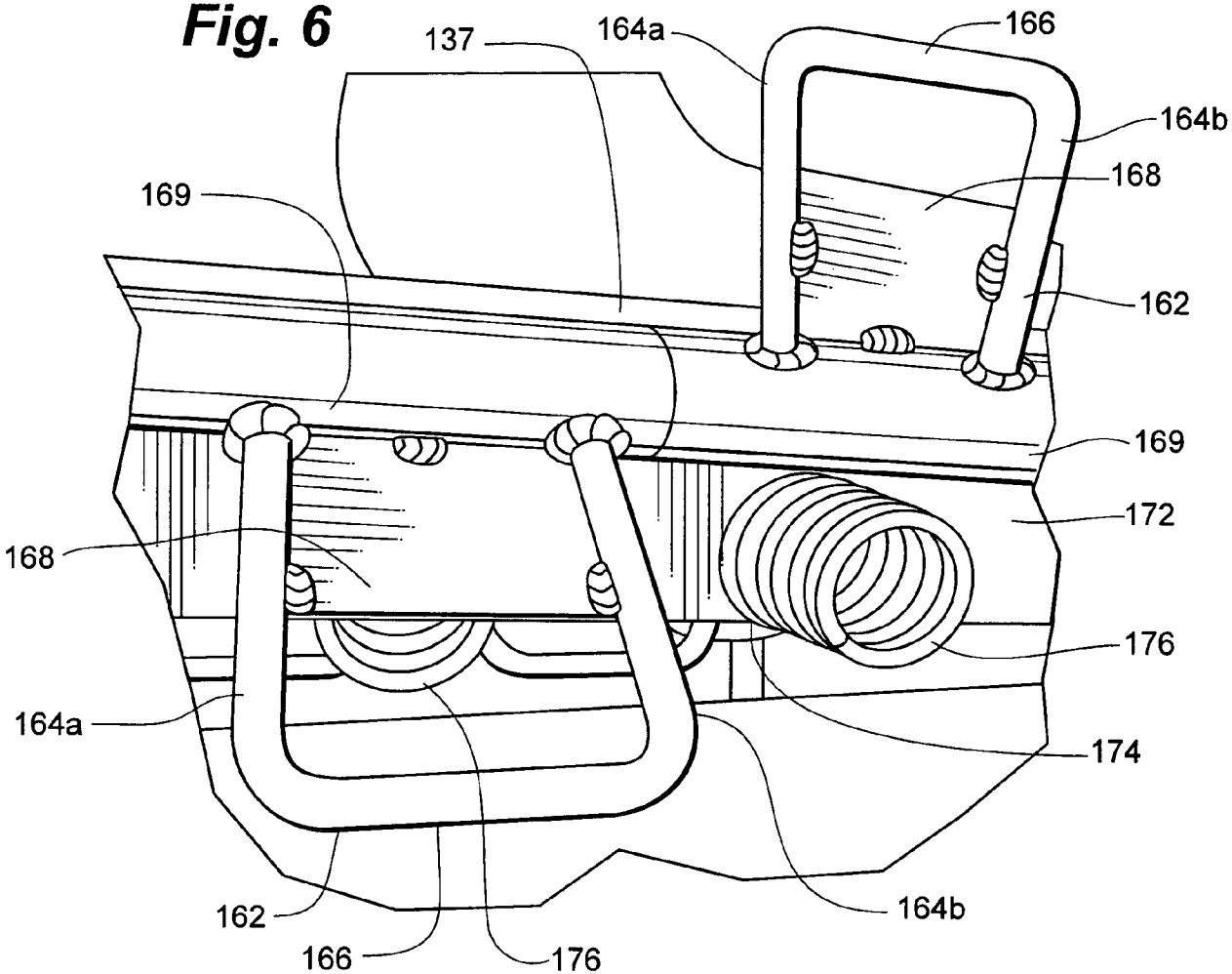
FIG. 6 is a perspective view of a pair of second flappers.

Each flapper assembly 140 comprises a first flapper 160 fixedly attached to the rotation rod 136 and a second flapper 162 rotatably mounted to the mounting rod 137 as shown in FIG. 6. First flapper 160 and second flapper 162 are constructed substantially the same as each include a pair of angled projecting arms 164*a*, 164*b* and a connecting arm 166. The first flapper 160 and second flapper 162 may comprise, for example, hot rolled ½ inch steel rods formed into the desired shape. In addition, each of the second flappers 162 includes a flapper plate 168 with a flapper mounting throughbore 169. In general, first flapper 160 and second flapper 162 have a generally triangular appearance such that the distance between the arms 164*a*, 164*b* increases from either the rotation rod 136 or the mounting rod 137 to the connecting arm 164. The first flappers 160 are preferably welded to the rotation rod 136 such that all of the first flappers 160 reside within a common plane. Each of the second flappers 162 is individually, slidably mounted about the mounting rod 137 using the flapper mounting throughbore 169. Both the first flappers 160 and the second flappers 162 are spaced such that each flapper assembly 140 corresponds to a funnel box 172 on a dispensing end 174 of each funnel 130. When assembled, each funnel box 172 has on opposing sides, a first flapper 160 and a second flapper 162. In addition, each funnel box 172, as depicted in FIG. 6, includes a biasing spring 176 oriented to engage the flapper plate 168 on each of the second flappers 162.

Figure 4:
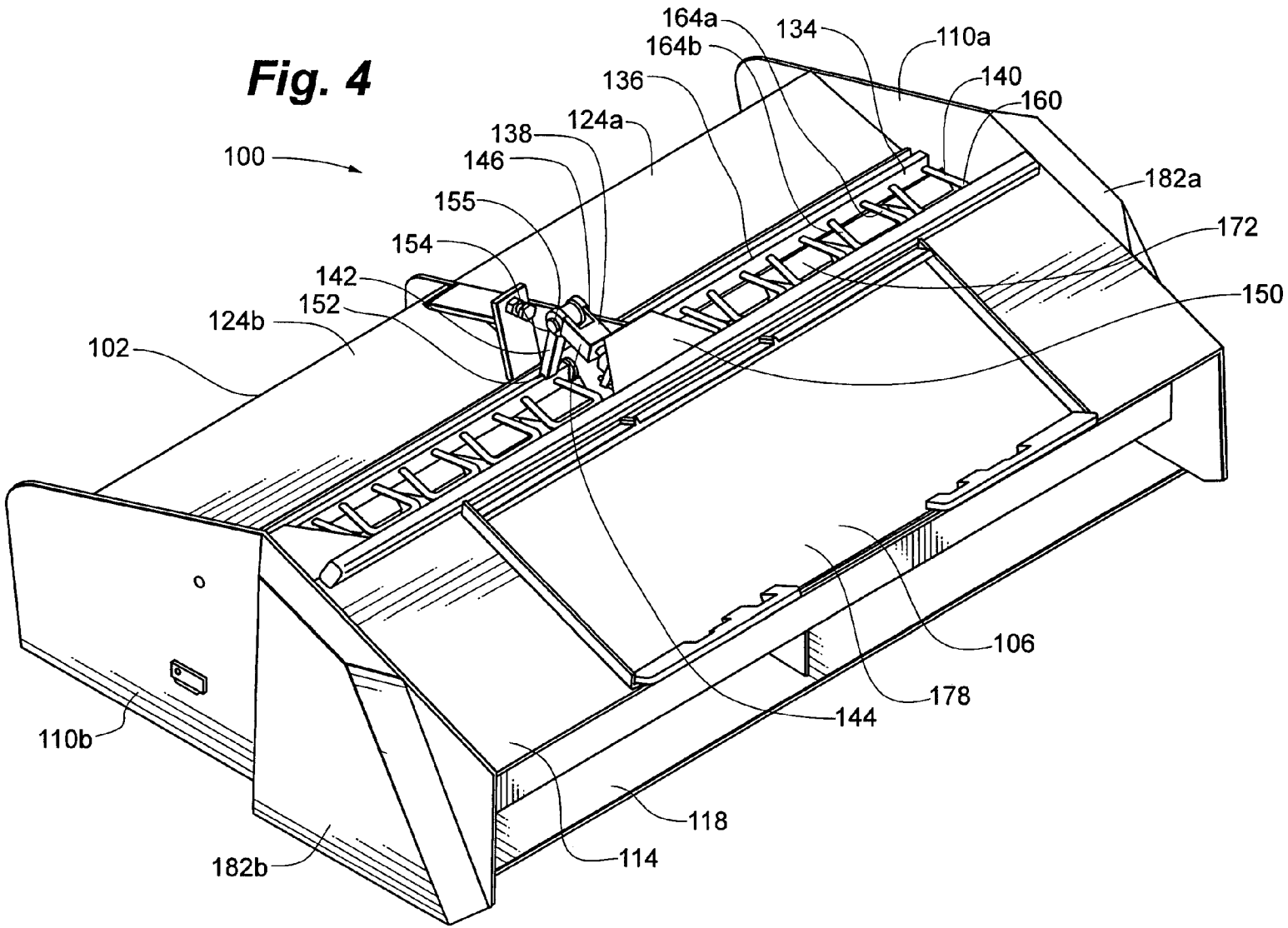
FIG. 4 is a rear, perspective view of the bucket loader of FIG. 1.

As depicted in FIG. 4, mounting portion 106 comprises a universal mounting plate 178, for example a quick-tach type mounting plate, welded to the mounting wall 114. Generally, the universal mounting plate 178 allows the bucket loader 100 to be used interchangeably with any suitable loading vehicle, for example an excavator, a skid-steer loader, a backhoe, a track loader, a front-end loader or other suitable loading vehicle, having a pair of arms adapted to interface with the universal mounting plate 178.

Figure 5:
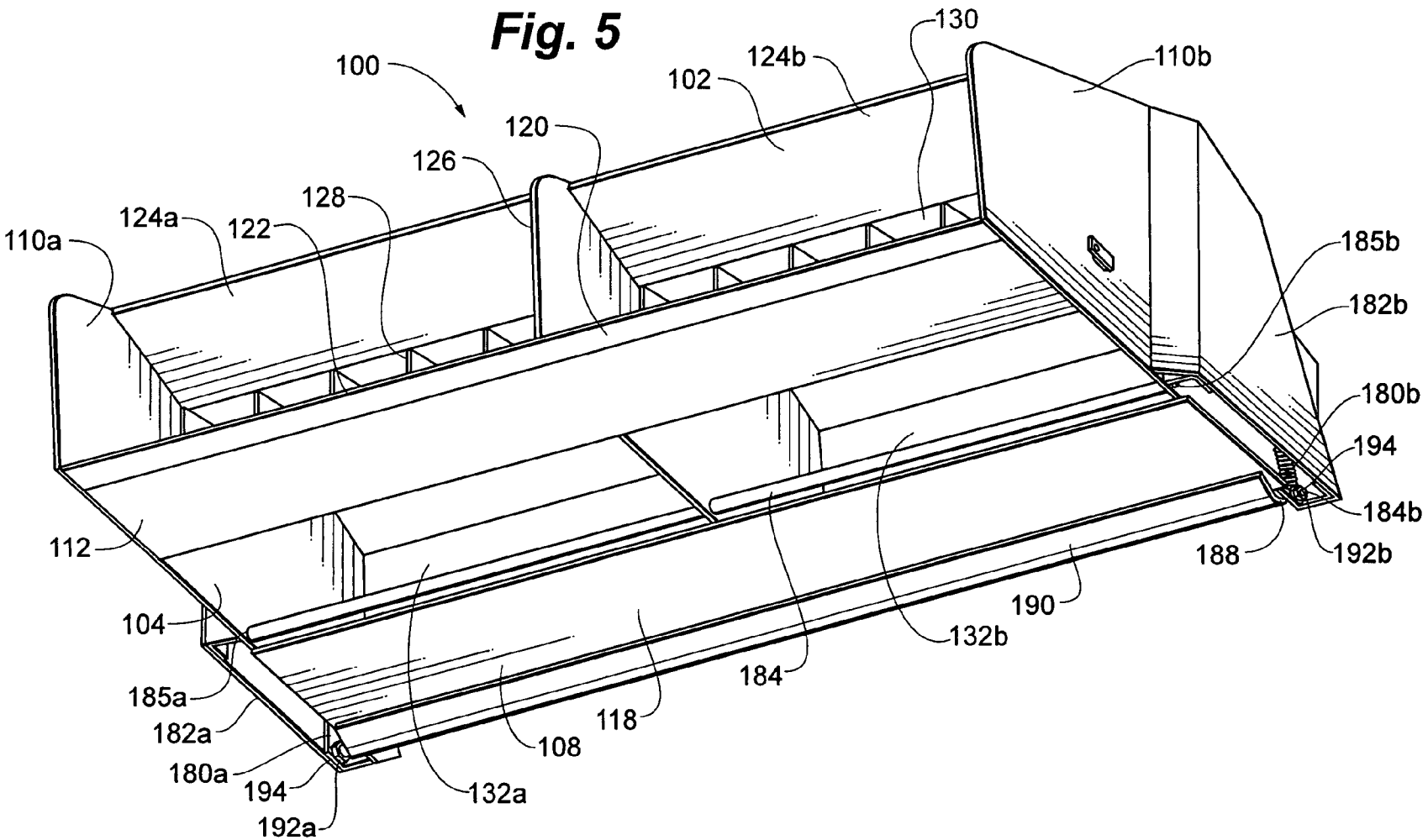
FIG. 5 is a bottom, perspective view of the bucket loader of FIG. 1.

Unloading portion 108 as depicted in FIG. 5, allows the bucket loader 100 to be unloaded of filled bags by manipulating the orientation of the bucket loader 100 with the loader. Unloading portion 108 includes the chute wall 118, a pair of chute springs 180*a*, 180*b* and a pair of spring covers 182*a*, 182*b*. Chute wall 118 includes a chute member 184 rotatably mounted between the sidewalls 110*a*, 110*b*. Chute member 184 can include a pair of mounting pins 185*a*, 185 projecting into opposed throughbores on the sidewalls 110*a*, 110*b*. Chute wall 118 can further includes a chute rod 188 retained within a formed chute retaining surface 190.

Preferably, chute retaining surface 190 is formed about the chute rod 188 such that the retaining surface 190 can be tacked to the chute wall 118 to permanently retain the chute rod 188. Both a first chute rod end 192*a* and a second chute rod end 192*b* are adapted for attachment to one of the chute springs 180*a*, 180*b*. The first chute rod end 192*a* and the second chute rod end 192*b* can be threaded such that the chute springs 180*a*, 180*b* are physically retained by a threaded nut 194. The opposing ends of the chute springs 180*a*, 180*b* can then be coupled to a projection or bore present between the sidewalls 110*a*, 110*b* and the corresponding spring covers 182*a*, 182*b*. The chute springs 180*a*, 180*b* are covered by the spring covers 182*a*, 182*b* to protect bystanders should the chute springs 180*a*, 180*b* break or become detached. Preferably, chute springs 180*a*, 180*b* have a combined spring tension of at least 100 pounds such that the chute wall 118 is biased shut as shown in FIG. 5.

Use of the bucket loader 100 is described with respect to FIGS. 7, 8, 9 and 10. As depicted, a conventional front-end loader 200 includes a pair of loader arms 202*a*, 202*b* adapted for coupling to the universal mounting plate 178. Front-end loader 200 is equipped such that loader arms 202*a*, 202*b* can raise and lower the bucket loader 100 while a pair of piston-cylinder devices 204*a*, 204*b* allow tilting of the bucket loader 100 to a variety of orientations. Front-end loader 200 further includes a hydraulic, pneumatic or electrical source for connection with the piston assembly 148.

Figure 8:
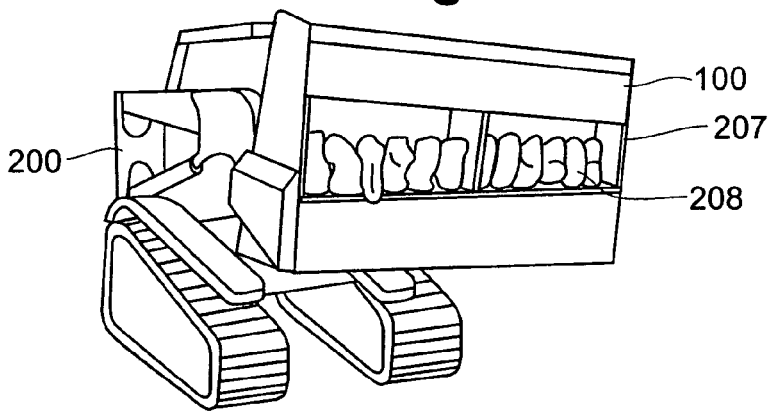
FIG. 8 is the loader vehicle of FIG. 7 with the bucket loader in a filling disposition.

Once the bucket loader 100 is physically and operably coupled to the loader 200, the loader 200 manipulates the bucket loader 100 to a filling disposition 207 as shown in FIG. 8. Using the hydraulic or pneumatic drive source, an operator directs the piston assembly 148 such that the mounting arm 144, and consequently the rotation rod 136, are caused to rotate such that the connecting arms 164 on the first flappers 160 approach the funnel box 172. An operator then attaches a bag 208 to each flapper assembly 140. The bag 208 includes a single bag opening and preferably has a bag length slightly exceeding the distance between the funnel box 172 and the rear support wall 116. The bag 208 is positioned such that the bag opening is placed around the second flapper 162. The bag opening is then directed over the funnel box 172 and around the first flapper 160. As the operator wraps the bag 208 over the first flapper 160, the biasing spring 176 is compressed between the funnel box 172 and the flapper plate 168. Once the bag 208 is placed over the first flapper 160, the operator releases the bag 208 whereby the compressed biasing spring 176 directs the second flapper 162 away from the funnel box 172 such that the bag 208 is retained by the flapper assembly 140 with the funnel box 172 positioned within the bag opening. The operator similarly attaches one bag 208 to each flapper assembly 140.

Once a bag 208 is attached to each flapper assembly 140, the operator manipulates the hydraulic, pneumatic or electronic drive source to actuate the piston assembly 148 resulting in the mounting arm 144, and consequently the rotation rod 136, rotating such that the connecting arms 164 on the first flappers 160 move away from the funnel boxes 172. This stretches the opening of the bags 208 such that each bag 208 is tightly retained by the flapper assemblies 140.

Figure 7:
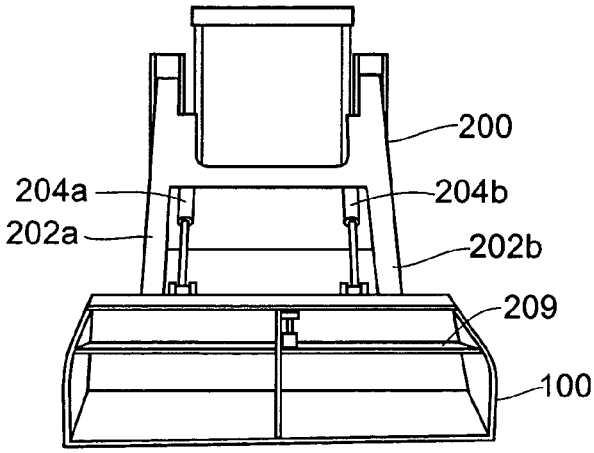
FIG. 7 is a loader vehicle including the bucket loader of FIG. 1 in a scooping disposition.
Figure 10:
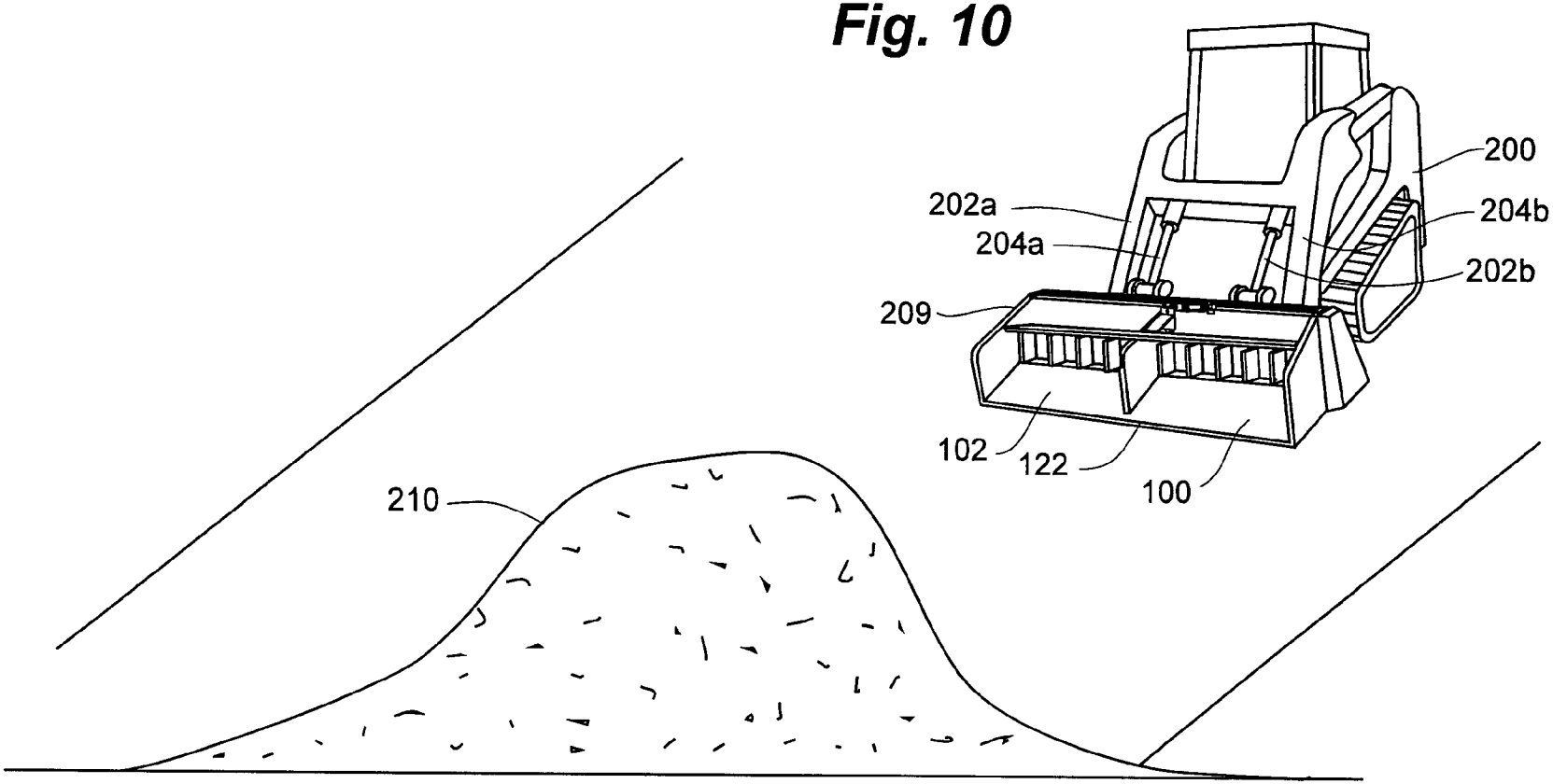
FIG. 10 is the loader vehicle of FIG. 7 preparing to scoop a flowable, granular material.

Following attachment of the bags 208, the loader arms 202*a*, 202*b* and piston-cylinder devices 204*a*, 204*b* are manipulated on the loader 200 such that the bucket loader 100 is oriented in a scooping disposition 209 as shown in FIGS. 7 and 10. In the scooping disposition 209, the loader 200 directs the bucket loader 100 into a pile of granular material 210 such that the leading edge 122 cuts into the granular material 210. The bucket loader 100 is directed forward by the loader 200 such that the scoop portion 102 is filled with granular material 210. Typically, the granular material 210 is sand, either wet or dry, or similar materials available at the site.

Once scoop portion 102 has been filled with granular material 210, the loader arms 202*a*, 202*b* and piston-cylinder devices 204*a*, 204*b* are manipulated with the loader 200 such that the bucket loader 100 is again oriented in the filling disposition 207 shown in FIG. 8. In the filling disposition 207, the granular material 210 is directed between the funnel walls 124*a*, 124*b* and the scoop floor 112. The granular material 210 is evenly distributed by the funnel dividing walls 128 whereby the granular material 210 flows into and through the funnels 130. The granular material 210 exits out of the dispensing end 174 of each funnel 130 and flows into the bags 208. As the bags 208 receive the granular material 210, the individual flapper assemblies 140 continue to retain the bags 208 due to the tension supplied through the rotation assembly 138.

Once filled, each bag 208 weighs on average fifty five to sixty pounds, though this will vary based on the dimensions of bag 208 and the make-up of granular material 210. The operator can then manipulate the drive source such that the piston assembly 148 rotates the mounting arm 144, and consequently the rotation rod 136, such that the connecting arms 164 of the first flappers 160 approach the funnel boxes 172. At this point, each flapper assembly 140 is no longer stretching the bag opening such that the bags 208 are supported by the rear support wall 116. The operator then drives the loader 200, with the bucket loader 100 in the filling disposition 207, to a point of use.

Figure 9:
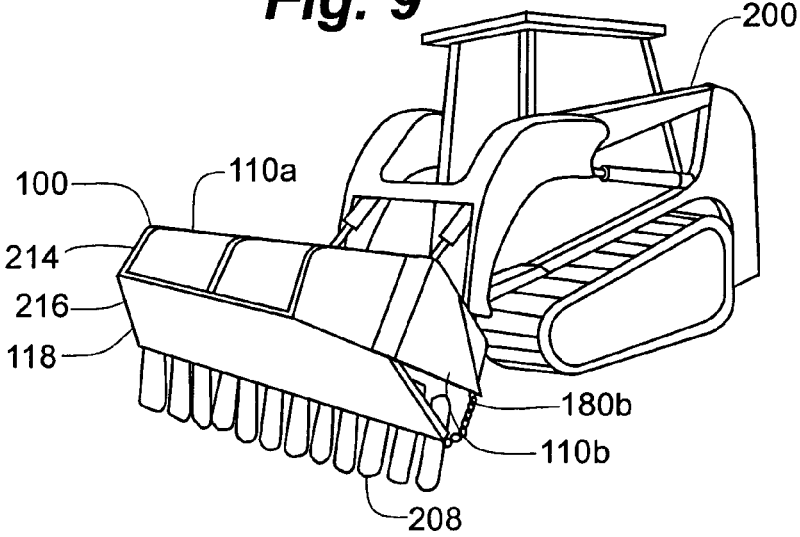
FIG. 9 is the loader vehicle of FIG. 7 with the bucket loader in an unloading disposition.

Once the loader 200 is positioned at the point of use, the operator manipulates the loader arms 202*a*, 202*b* and piston-cylinder devices 204*a*, 204*b* such that the bucket loader 100 is in an unloading disposition 214 as shown in FIG. 9. As the bucket loader 100 is rotated from the filling disposition 207 to the unloading disposition 214, the weight of the granular material 210 within the bags 208 becomes increasingly supported by the chute wall 118. Once the bucket loader 100 is in the unloading disposition 214, the combined weight within the filled bags 208, approximately 660–720 pounds in the preferred embodiment, is supported by chute wall 118. As the combined weight of the bags 208 exceeds the combined spring tension of the chute springs 180*a*, 180*b*, the chute wall 118 rotates about the chute member 184 to an open chute disposition 216 shown in FIG. 9 with respect to the sidewalls 110*a*, 110*b*. As the chute wall 118 rotates to the open disposition 216, the bags 208 begin to slide out of the mounting portion 106 whereby they are deposited at the point of use in an upright disposition. Once all of the bags 208 are positioned, the operator can repeat the process by attaching another set of bags 208 to the flapper assemblies 140 as discussed above.

It is understood that this invention is not intended to be unduly limited by the illustrative embodiments and examples set forth herein and that such examples and embodiments are presented by way of example only.

What is claimed is:

1. A bag filling bucket loader for attachment to a loader comprising:

a scooping means for scooping a flowable granular material, the scooping means comprising a scoop surface and a plurality of individual funnel sections for directing the flow of the granular material;

a bag attachment means comprising a plurality of flapper assemblies adapted for selectively retaining a plurality of fillable bags, one flapper assembly being positioned at a dispensing end of each funnel section, the flapper assemblies adapted to selectively attach a plurality of fillable bags and selectively release a plurality of filled bags;

a bucket attachment means for removably coupling the bucket loader to the loader, the attachment means allowing the loader to selectively orient the bucket loader from a scooping disposition for scooping the granular material, a filling disposition whereby the granular material is directed into the fillable bags creating the filled bags, and an unloading disposition for positioning the filled bags at a desired location; and an unloading means comprising a rotatable unloading chute for depositing the filled bags in an upright orientation when the bucket loader is directed to the unloading disposition.

2. The bag filling bucket loader of claim 1, wherein the rotatable, unloading chute is rotatably biased in a closed disposition by a pair of chute springs, the plurality of filled bags overcoming a retention force of the chute springs causing the rotatable, unloading cute to rotate to an open disposition when the bucket loader is in the unloading disposition.

3. The bag filling bucket loader of claim 2, wherein the chute springs are individually protected during the scooping of the granular material by a spring cover.

4. The bag filling bucket loader of claim 1, wherein each flapper assembly comprises a first triangular flapper and a second triangular flapper mounted on opposed sides of each funnel section, the first triangular flapper adapted to selectively rotate between an attachment position and a retaining position with respect to each funnel section while the second triangular flapper includes a resilient biasing means adapted to rotatably bias the second triangular flapper away from the funnel section.

5. The bag filling loader of claim 4, wherein the first triangular flappers are fixedly coupled to a rotating member, the rotating member being selectively rotated at the direction of an actuatable piston device connected to the rotating member.

6. The bag filling loader of claim 5, wherein the actuatable piston device is selectively actuated by a remotely located and controlled, pneumatic, hydraulic or electrical drive source, the remotely located drive source being present on and selectively controlled from the loader.

7. A method for simultaneously filling a plurality of fillable bags with a flowable material, the comprising:

attaching each of a plurality of fillable bags to a bag filling bucket loader, each bag individually and proximally attaching to a funnel section integral to the bucket loader, the bucket loader further including a coupling means for operably coupling the bucket loader to a loader vehicle;

scooping a flowable material with the bucket loader, the loading vehicle operably positioning the bucket loader in a scooping disposition whereby the loading vehicle directs a scooping portion of the bucket loader into a pile of the flowable material;

directing the flowable material from the scooping portion, through the funnel sections and into the fillable bags by operably positioning the bucket loader in a loading disposition with the loading vehicle to create a plurality of filled bags;

releasing the filled bags from proximal attachment to the funnel sections whereby the filled bags are supported by a support floor in the loading disposition;

driving the loader vehicle to a point of use; and unloading the plurality of filled bags at the point of use by operably positioning the bucket loader in an unloading disposition with the loading vehicle, an unloading chute rotatably opening under the direction of the plurality of filled bags.

8. The method of claim 7 wherein the plurality of fillable bags are rotatably attached and the plurality of filled bags are rotatably released using an automated rotatable attachment system.

9. The method of claim 8 wherein the automated rotatable attachment system comprises a plurality of flapper assemblies, one flapper assembly corresponding to each of the funnel sections, each flapper assembly having a first triangular flapper and a second triangular flapper, the first triangular flapper and the second triangular flapper being opposably mounted with respect to each funnel section, all of the first triangular flappers being fixedly coupled to a common rotation rod while the second triangular flappers are individually mounted to a common mounting rod, the rotation rod being rotatably directed with an actuatable piston assembly.

10. The method of claim 9 wherein the actuatable piston assembly is actuated by a drive source on the loading vehicle, the drive source actuating the actuatable piston assembly either pneumatically, hydraulically or electronically.

11. The method of claim 7 wherein the unloading chute rotatably opens in the unloading disposition as a total mass of the filled bags overcoming a retention force, wherein said retention force otherwise retains the unloading chute in a closed position.

12. The method of claim 11 wherein the retention force is provided by a pair of springs, operably attached between the unloading chute and the bucket loader.

13. A bag filling bucket loader comprising:

a scoop portion, a mounting portion, an unloading portion and a universal mounting connector, wherein said universal mounting connector is adapted for operably coupling the bucket loader to a loading vehicle such that the bucket loader can be selectively raised, lowered and tilted with respect to the loading vehicle resulting in a scooping disposition, a filling disposition and an unloading disposition, wherein said scoop portion comprises a scooping surface for scooping a granular, flowable material in the scooping disposition and a plurality of integral funnel sections operably connecting the scoop portion with the mounting portion, wherein the mounting portion includes a bag attachment assembly for selectively retaining and releasing a plurality of bags, each of the plurality of bags corresponding to one of the funnel sections such that the granular, flowable material can be directed from the scoop portion, through the plurality of funnel sections and into the plurality of bags in the filling disposition; and wherein the unloading portion includes a rotatable chute having a spring closure assembly, the plurality of filled bags having a total mass exceeding a retention force supplied by the spring closure assembly in the unloading disposition such that the rotatable chute rotates to an open position for slidably releasing the plurality of bags at a point of use.

14. The bag filling bucket loader of claim 13 wherein the bag attachment assembly comprises a plurality of flapper assemblies, one flapper assembly corresponding to each of the funnel sections, each flapper assembly having a first triangular flapper and a second triangular flapper, the first triangular flapper and the second triangular flapper being opposably mounted with respect to each funnel section, all of the first triangular flappers being fixedly coupled to a common rotation rod while the second triangular flappers are individually mounted to a common mounting rod, the rotation rod being rotatably directed with an actuatable piston assembly.

15. The bag filling bucket loader of claim 14 wherein the actuatable piston assembly is actuated by a drive source on the loading vehicle, the drive source actuating the actuatable piston assembly either pneumatically, hydraulically or electronically.

16. The bag filling bucket loader of claim 15 wherein the spring closure assembly comprises a pair of springs individually mounted between the rotation chute and the bucket loader, each spring being individually protected during the scooping of the granular material by a spring cover.

* * * * *